United States Patent [19]

Rappaport et al.

[11] Patent Number: 4,713,945

[45] Date of Patent: Dec. 22, 1987

[54] TURRET FOR CRYOSTAT

[75] Inventors: Michael L. Rappaport, Ramat Hasharon; Leif Blumenau, Beersheva, both of Israel

[73] Assignee: Elscint Ltd., Haifa, Israel

[21] Appl. No.: 885,649

[22] Filed: Jul. 15, 1986

[30] Foreign Application Priority Data

Jul. 30, 1985 [IL] Israel ..... 75968

[51] Int. Cl.[4] ..... F25B 19/00

[52] U.S. Cl. ..... 62/514 R; 250/352

[58] Field of Search ..... 62/45, 514 R; 250/352

[56] References Cited

U.S. PATENT DOCUMENTS

| | | | |
|---|---|---|---|
| 4,279,127 | 7/1981 | Longsworth | 62/514 R |
| 4,391,028 | 7/1983 | Choudhury et al. | 62/514 R |
| 4,502,296 | 3/1985 | Ogata et al. | 62/514 R |
| 4,510,771 | 4/1985 | Matsuda et al. | 62/514 R |
| 4,516,404 | 5/1985 | Laskaris | 62/514 R |
| 4,522,034 | 6/1985 | Laskaris | 62/514 R |
| 4,526,015 | 7/1985 | Laskaris | 62/514 R |
| 4,535,595 | 8/1985 | Keller | 62/514 R |
| 4,535,596 | 8/1985 | Laskaris | 62/514 R |

*Primary Examiner*—Ronald C. Capossela

*Attorney, Agent, or Firm*—Sandler & Greenblum

[57] ABSTRACT

A turret system providing access to the interior of a vacuum vessel integral to a cryostat used for super conducting magnets in MRI systems. The system enabling the movable connection of a neck tube that provides access to the interior of the vacuum vessel when that tube is fixedly attached to the liquified gas container of the cryostat and moves with the liquified gas container, said moveable connection being affected by a supple member attaching said neck tube to said vacuum member, so that relative movement between said liquified gas container and said vacuum vessel does not over-stress said neck tube.

15 Claims, 3 Drawing Figures

TURRET FOR CRYOSTAT

FIELD OF THE INVENTION

This invention is concerned with cryostats and especially with cryostats such as are used to provide superconducting magnets for magnetic resonance (MR) systems.

BACKGROUND OF THE INVENTION

The diagnosis of human ailments by the medical profession has been significantly upgraded by the new and improved equipment for imaging the interior of patients. In recent times imaging systems that do not use dangerous radiant energy such as magnetic resonance imaging systems (MRI) have come into vogue. Such systems significantly reduce the danger of exposure to radiation and nonetheless provide images of patients that are at least on a par with images acquired using x-rays.

One of the methods for obtaining magnetic resonance (MR) images employs superconducting magnets to provide the required high static magnetic fields. The superconducting magnets use cryostats to provide the low temperatures necessary for the supeconducting condition. The cryostats presently used to obtain whole body images are for the most part horizontal cylinders with room temperature bores that are large enough to receive the body of the patient. The low temperature is maintained using liquified gases such as helium. Access to the container or tank for the liquified gases is obtained through a vertical turret attached to the horizontally oriented cylindrical cryostat. The helium tank includes the superconducting magnet itself in a "bath" of liquid helium. It is usual to use a container of liquid nitrogen juxtaposed to the helium tank to reduce helium boil-off. Both the nitrogen and helium containers are in a vacuum vessel and the containers are cylindrical units with circular cross sections co-axial with and surrounding the bore.

The turret basically comprises a "neck" tube which in general is a large diameter thin wall vertical tube typically of a diameter of approximately 4 inches made of stainless steel. The neck tube is connected by means such as welding to the helium container. A neck tube flange is connected by means such as welding near the top of the tube.

In the prior art, the neck tube flange is rigidly mounted to the walls of the vacuum vessel. The neck tube and the flange of the prior art form a vacuum boundary as part of the vacuum vessel.

An inverted can referred to in general as a "top hat" is connected by means such as bolts to the top of the neck tube flange. The top of the "top hat" contains ports for such things as the superconducting magnet current leads as well as for providing access to the liquid helium and liquid level guages, temperature sensors and safety means such as pressure release devices.

In order to minimize the conductive heat load of the helium container, it is not rigidly coupled to the cryostat. The helium container, is thus, able to move, albeit slightly in axial, rotational and transverse directions. In addition the radius of the helium container shrinks by several millimeters when it is cooled to the temperature of the liquid helium from room temperature. These movements require flexibility in the neck tube to keep it from being over stressed and even actually breaking thereby rupturing the vacuum vessel and providing a path for helium to get into the vacuum vessel.

In the prior art a metal bellows is often included integral to the neck tubes. Such prior art neck tubes comprise a metal bellows between straight cylindrical sections. The connection between the straight cylindrical sections and the bellows must of course be leak tight because any leak would introduce the helium to the vacuum space of the cryostat. Even using the integral bellows in the neck tube, the tube and bellows assembly still is not sufficiently movable to enable the rotation of the container about its own axis. Even a rotation of less than a degree overstresses the neck. Such a rotation could be induced by non-uniform strain during cool down or be caused by the presence of ferro-magnetic material near the cryostat when the magnet is energized. The problem of preventing stress cannot be solved by mounting the helium container more rigidly in order to prevent the stress causing movement because such mounting increases helium boil off and thereby increases the cost of operating the cryostat.

Accordingly there is a present and long standing need for providing neck tubes of the turrets that are sufficiently supple to move in different directions without inducing helium boil off and/or decreasing the life of the cryostat.

BRIEF DESCRIPTION OF THE INVENTION

According to the present invention, an improved turret providing access to the liquid gas container in the interior of the vacuum vessel means in cryostats used for superconducting magnets in MR systems is provided:

said cryostat comprises a vacuum vessel shaped as a horizontal cylinder with a room temperature bore along the longitudinal axis of said cylinder, said vacuum vessel containing a tank of liquified gas, said tank built in the form of a horizontal cylinder having a bore therethrough coaxial with the bore of said vacuum vessel, said tank containing the superconducting magnet, neck tube means in said turret extending from said tank to the exterior of the cryostat, means for fixedly attaching said neck tube to said tank, and means for movably attaching said neck tube to said vacuum vessel, to thereby provide said neck tube means with access to the interior of the tank without being subjected to stresses caused by movements of said tank.

A related feature of the invention comprises:

supple means to connect the vacuum vessel means and the neck tube.

A further related feature of the invention comprises rigidly connecting the neck tube to the tank and utilizing a resilient material having an arcuate shape for movably connecting the neck tube to the vacuum vessel.

Yet another feature of the invention comprises utilizing a material such as elastomer for the resilient material.

Still another feature of the invention comprises utilizing a flexible member, such as a bellows, external to the actual neck tube for enabling movement of the neck tube without subjecting the system to stress that could result in loss of liquified gas or even disable the cryostat.

BRIEF DESCRIPTION OF THE DRAWINGS

The above mentioned features and objects of the present invention will be better understood when considered in the light of the following description of the invention made in conjunction with the accompanying drawings; wherein.

GENERAL DESCRIPTION

Figure 1:
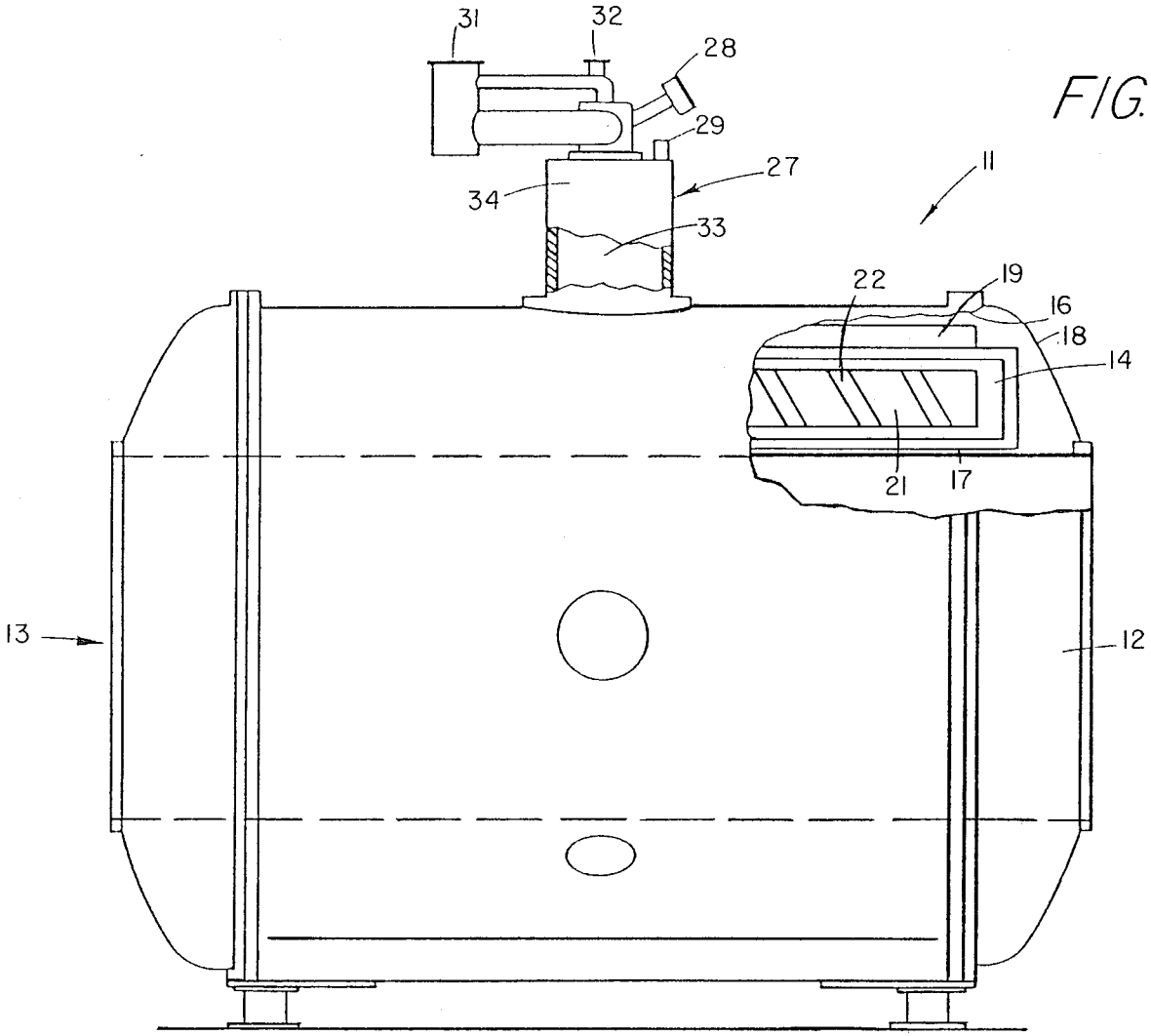
FIG. 1 is a partial broken-away drawing of a cryostat of a type used in MR systems.

FIG. 1 at 11 shows a cryostat of a type used in MRI systems. The cryostat comprises an outer vacuum chamber or vessel 12 surrounding the entire unit. The cryostat also has an interior room temperature bore 13 for receiving patients therein during the imaging process using magnetic resonance techniques. The breakaway section of FIG. 1 shows the interior of the and vacuum vessel 14. The interior of the vessel is defined by an outer wall 16 and an inner wall 17 as well as end wall 18. Within the vacuum vessel there is a nitrogen container 19 and a helium container 21. Within the helium container is the coil 22 of the superconducting magnet.

More important to the explanation of the instant invention is an access turret 27. It is through this access turret that electricity is supplied to the magnet coils, and the liquid "refrigerants" such as liquid helium and nitrogen are supplied to the containers.

At the top of the access turret there is shown an electrical connector 28 for such things as level gauge and thermometers, a port 29 for the helium, a ventilation port 31 and a nitrogen access port 32. The helium is normally supplied through the access turret 27 via a neck tube 33. The neck tube is shown as an open cylindrical tube of about 4 inches in diameter. It is this neck tube that must be flexible, because of the inherent motion of the helium container to which it is rigidly connected. The helium container tends to move longtitudinally, to radially shrink and expand, and to rotate about the axis of the neck tube. It is this rotation about the axis of the neck tube that is especially troublesome in the prior art.

The top 34 of the neck tube 33 has attached thereto by welding, or other means a flange 36. (FIG. 2) A shroud 35 known popularly as a "top hat" is attached to the flange by means of fastners such as fastener 37. The "top hat" covers the top 34 of the neck tube.

The neck tube is fixedly attached to the helium container at point 40 by welding for example. Thus, an object of the invention; i.e. having flexibility between the neck tube and the cryostat is accomplished by movably attaching the neck tube to the vacuum vessel.

Figure 2:
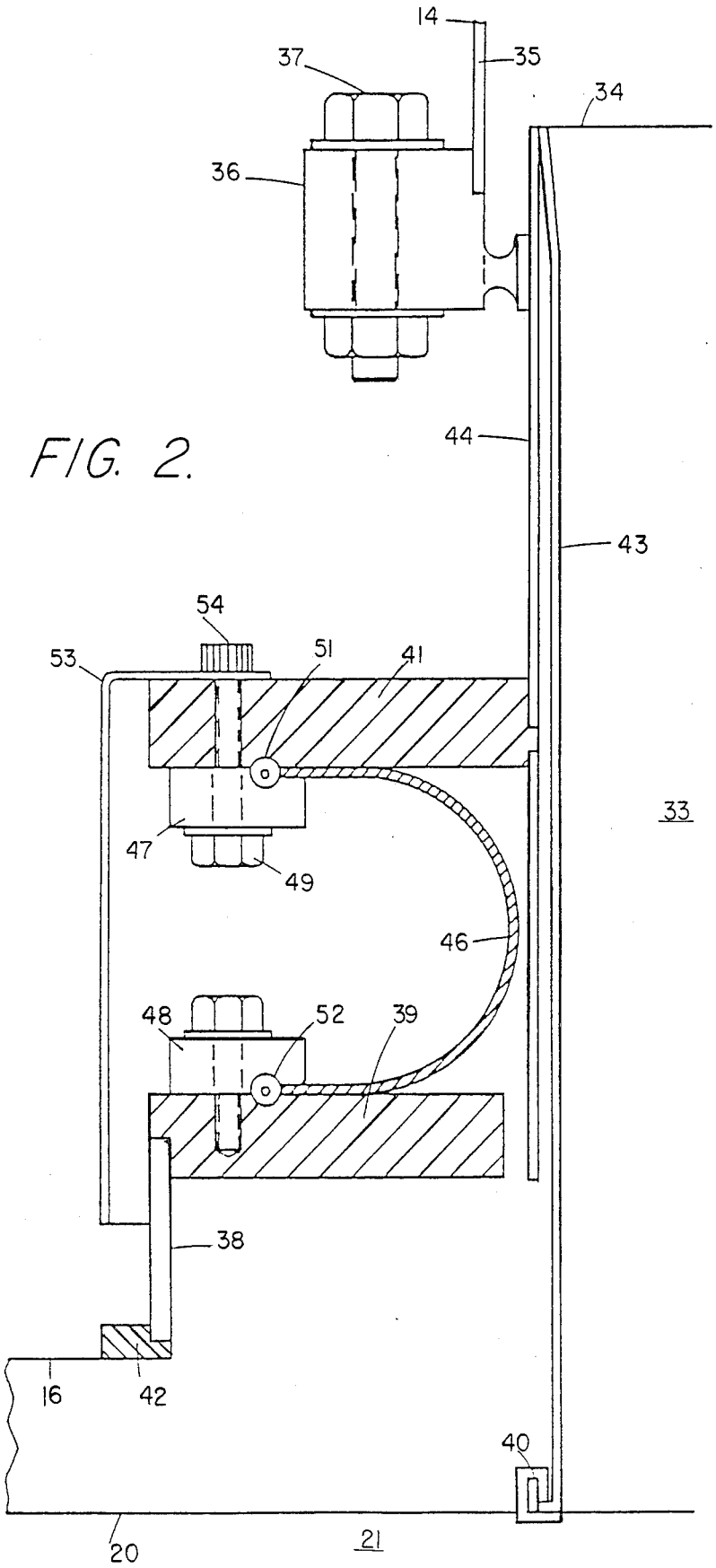
FIG. 2 is an embodiment of a turret arrangement having a movable neck tube.

The vacuum vessl is an integral part of the cryostat shown in FIG. 1 and is defined by the outer walls 16, the inner walls 17 and the side wall 18. FIG. 2 shows the neck tube penetration of the vacuum vessel. The integrity of the vacuum vessel is maintained by a wall 38 anchored to the outer wall 16 of the vacuum vessel at anchor flange 42. Wall 38 is rigidly attached to an inner clamping flange 39. A member 46 is attached between an outer clamping flange 41 and the inner clamping flange 39. The member 46 is designed to provide "give" enabling movement between flanges 39 and 41 without endangering the vacuum or stressing the neck tube. Thus member 46 may be resilient or shaped to provide flexibility i.e. convoluted, arcuate or pleated for example. In addition it may combine resiliency with shaping.

The neck tube 33 comprises an inner wall 43 and an isolation tube of slightly larger diameter comprised of outer wall 44. There is a vacuum between the walls 44 and 43.

The outer clamping flange 41 is rigidly attached to the isolation tube 44. Any movement between the helium container 21, to which the neck tube is affixed at 40, and the vacuum vessel is absorbed by the flexible/-resilient member 46. Any movement of the helium tank is transferred to flange 41. There is sufficient flexibility and/or resiliency in member 46 to absorb all movement between the helium tank and the vacuum vessel and consequently between the neck tube 33 and the cryostat without placing any strain on the component parts of the cryostat and/or the neck tube.

Means are provided for clamping member 46 between the flanges 39 and 41. More particularly at each flange there is a clamping ring, shown as clamping rings 47 and 48 fastened to flange 41 and 39 respectively. Threaded fastners, such as fastner 49, affix the clamping rings to the flanges. In a preferred embodiment the clamping rings clamp on to a steel ring 51, which is at the termination of member 46. The member 46 in the embodiment of FIG. 2 has an elongated arcuate shape.

A shroud or spinning 53 is also attached to flange 41 by means of fastner 54. The shroud 53 protects the member 46, and also acts as a heat sink to help maintain flange 41 near room temperature.

As shown in FIG. 2 any movement of the helium container 21 causes movement of the neck tube 33. The neck tube movements in any direction are absorbed by member 46 without any strain on the vacuum vessel and without using any bellows integral to the neck tube. The inventive arrangement thereby avoids the problems encountered when using a neck tube that has vertical bellows integral thereto.

Figure 3:
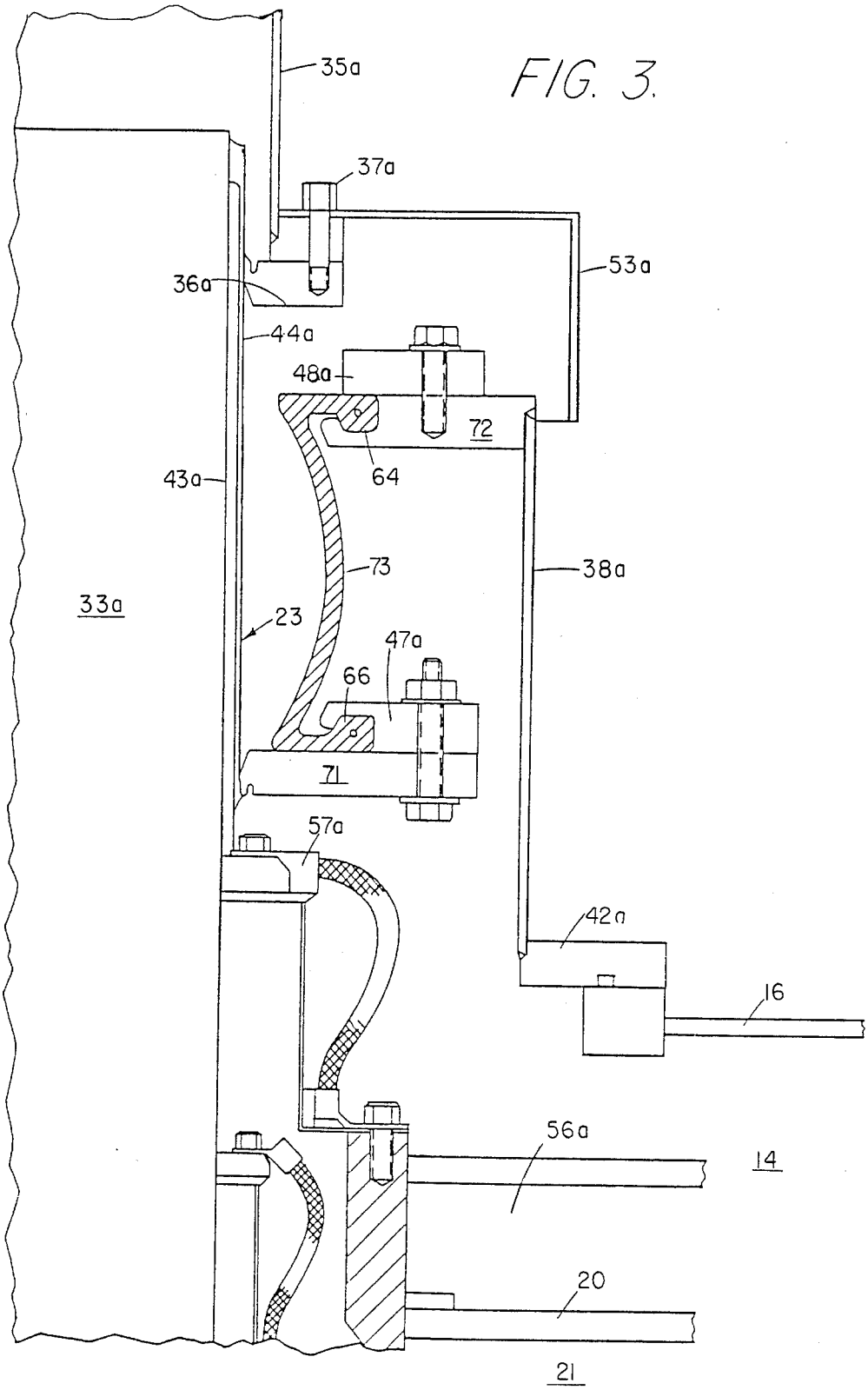
FIG. 3 is another embodiment of the invention rendering the neck tube movable while minimizing the neck tube stress.

The fact that the invention is not limited to the exact shape of the means for the flexible interconnection between the rigid parts of the cryostat and the moving parts of the cryostat, is emphasized by the embodiment of FIG. 3. Therein is shown a different embodiment than that of FIG. 2 but which accomplishes the same purposes and gains the same benefits.

In the embodiment of FIG. 3 the neck tube 33*a* is shown as having an inner wall 43*a* surrounded by an isolation tube 44*a*. In FIG. 3 there is also shown a flange 36*a* rigidly attached to the top portion of the neck tube 33*a*. Attached to the flange, by means such as threaded fastener 37*a*, is the top hat 35*c*. A spinning or shroud 53*a* is also provided in the embodiment of FIG. 3.

Fixedly attached to isolation tube 44*a* is an inner clamping flange 71. An outer clamping flange 72 is attached to wall 38*a* which is in turn affixed to outer wall 16 of the vacuum vessel 14. A member 73 designed to provide "play" or "give" between the "moving" helium tank 21 and the stationary vacuum vessel extends between the flanges 71 and 72. The member 73 (and member 46 of FIG. 2) is designed to withstand atmospheric pressure; i.e. be impermeable as well to be flexible and have to a life-time at least equal to the life time of the rest of the cryostat.

In one preferred configuration of member 73, it is made of neoprene rubber reinforced with rayon cloth.

On its edge there is a stainless steel ring surrounded by characterized portions shown as 64 and 66. These characterized portions fit either into a characterized depression in flange 72 or into clamping ring 47*a* to thereby affix member 73 in place as one of the boundaries of the vacuum vessel. Member 73 is basically arcuately shaped with clamping handles extending in the direction of the summit of the arc. The helium container is not shown in FIG. 3. However, the neck tube extends to the helium container. A heat sink 57*a* is shown but not explained since it is not pertinent to an understanding of the basic invention.

In the embodiment of FIG. 3, the atmospheric pressure is on the side of the neck tube extending around shield 53*a* to the neck tube side of the member 73. The other side of member 73 i.e. wall 38*a* side contains the vacuum.

The present invention, in practice, eliminates dangerous torque or stress on the neck tube by enabling the entire neck tube to rotate or move. The rotation or movement is absorbed by a flexible and or extendable member part of the boundary between atmospheric pressure and the vacuum. The member absorbs axial, radial, transverse and rotational motion of the helium tank, as well as its shrinkage and expansion upon cooling and relative heating. The necessity of a metal bellows in the neck tube used in the prior art is obviated. The elimination of the integral bellows is benefical for a plurality of reasons, among them are that the neck tube without the bellows as an integral part thereof avoids the use of unreliable sections. The thinness of the material at the crest of the bellows makes the bellows the weakest part in the neck tube for the absorption of stress. Thus a critical weakness to torque is eliminated. Another advantage is that heat sink rings can be conveniently attached anywhere on the neck tube in order to minimize helium consumption. This advantage is illustrated by the showing of the heat sink 57.

Further benefit of the flexible turret arrangement provided herein is that the ports on the top of the "top hat" move with the helium container. They therefore remain aligned with the respective connectors which are rigidly mounted to the helium container. The spinning 53 provided an added protection by preventing small objects from falling between the elastomer flexible member (46 or 73) and the isolation tube. The spinning also provents water which is condensed at the top hat from flowing down into the area between the flexible member and the isolation tube. In addition, the spinning is fabricated from high thermal conducting material such as copper or aluminum, such material keeps flange 36*a* and thus also isolation tube 44*a* from freezing so that the elastomer will not freeze. Flange 36*a* gets very cold during transfer of helium and during quench.

While the invention has been described with the use of particular embodiments, it should be understood that these embodiments are not used as limitations on the scope of the invention but are given merely by way of example.

What is claimed is:

1. A turret arrangement in a cryostat used in magnetic resonance (MR) systems, said turret arrangement providing access to the interior of a vacuum vessel integral to the cryostat; said cryostat comprising:

(a) said vacuum vessel shaped in the form of a horizontal cylinder having a bore extending therethrough along the longitudinal axis of said cylinder;

(b) said vacuum vessel containing a liquified gas container;

(c) said liquified gas container providing the cooling necessary to obtain superconducting conditions and being shaped in the form of a horizontal cylinder having a bore therethrough that is coaxial with the bore of said vacuum vessel;

(d) said container being caused to move within the vacuum vessel axially, radially and transversely due to temperature extremes within said cryostat;

(e) a turret extending radially outward from said vacuum vessel;

(f) a neck tube rigidly attached to and extending radially from said container toward the outside of said vacuum vessel through said turret; and (g) bearingless means for movably attaching said neck tube to said vacuum vessel whereby, when said container moves, stresses on said neck tube are minimized.

2. The turret system of claim 1 wherein said liquified gas is helium.

3. The turret system of claim 1 wherein said means for movably attaching said neck tube comprises a supple member attached between the neck tube and the vacuum vessel, said supple member capable of being stretched because of relative movement of said neck tube and said vacuum vessel without being overstressed.

4. The turret system of claim 3 wherein said supple primarily member is supple due its shape.

5. The turret system of claim 4 wherein said supple member is arcuately shaped.

6. The turret system of claim 3 wherein said supple primarily member is supple due to the material from which it is made.

7. The turret system of claim 6 wherein said supple member is comprised of elastomer material.

8. the turret system of claim 6 wherein said supple member is comprised of neoprene rubber reinforced with rayon, whereby it is impermeable and flexible.

9. The turret system of claim 3 wherein said supple member is supple due to a combination of shape and material.

10. The turret system of claim 3 and first anchor flange means for fixedly attaching said supple member to said neck tube, second anchor flange means for attaching said supple member including steel rings defining the ends thereof to said vacuum vessel, clamp means for clamping said steel rings to said flange members in a vacuum tight manner.

11. The turret system of claim 10 wherein said second anchor flange means is attached to tube means which is substantially parallel to said neck tube means and surrounds said neck tube means and is fixedly attached to said vacuum vessel to thereby extend said vacuum in a vertical direction.

12. The turret system of claim 3 including spinning means for protecting said supple member.

13. The turret arrangement of claim 1 wherein:

(a) said means for movably attaching said neck tube to said vacuum vessel comprises extending means for extending said vacuum vessel along the neck tube of the turret;

(b) said extending means including a supple member movable in all directions surrounding said neck tube;

(c) means for attaching said supple member to said neck tube;

(d) means for attaching said supple member to said vacuum vessel so as to have one side of said supple member in the vacuum and the other side in the atmosphere;

(e) said means for attaching said supple member to said vacuum vessel including wall means for extending said vacuum vessel; and (f) said wall means being substantially parallel to said neck tube to extend said vacuum vessel.

14. The turret arrangement of claim 13 wherein said means for attaching said supple member to said vacuum vessel is above said means for attaching said supple member to said neck tube.

15. The turret arrangement of claim 13 wherein said means for attaching said supple member to said vacuum vessel is below said means for attaching said supple member to said neck tube whereby the vacuum of the vacuum vessel is extended along and juxtaposed to said neck tube to enable surrounding said neck tube in a vacuum for substantially its entire length.

* * * * *